US011542775B2

(12) United States Patent
Horne et al.

(10) Patent No.: US 11,542,775 B2
(45) Date of Patent: Jan. 3, 2023

(54) ANTI-EXTRUSION ASSEMBLY AND A SEALING SYSTEM COMPRISING SAME

(71) Applicant: NORTHSTAR DRILLSTEM TESTERS, Calgary (CA)

(72) Inventors: Andrew Horne, Carp (CA); Dragan Martinovic, Calgary (CA)

(73) Assignee: NORTHSTAR DRILLSTEM TESTERS, Calgary (CA)

( * ) Notice: Subject to any disclaimer, the term of this patent is extended or adjusted under 35 U.S.C. 154(b) by 0 days.

(21) Appl. No.: 17/270,389

(22) PCT Filed: Aug. 20, 2019

(86) PCT No.: PCT/CA2019/051133
§ 371 (c)(1),
(2) Date: Feb. 22, 2021

(87) PCT Pub. No.: WO2020/037407
PCT Pub. Date: Feb. 27, 2020

(65) Prior Publication Data

US 2021/0246757 A1 Aug. 12, 2021

Related U.S. Application Data

(60) Provisional application No. 62/719,802, filed on Aug. 20, 2018.

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/128; E21B 33/1216
See application file for complete search history.

(56) References Cited

U.S. PATENT DOCUMENTS 2,921,632 A 1/1960 Clark
5,678,635 A 10/1997 Dunlap
(Continued)

FOREIGN PATENT DOCUMENTS

WO 2012024063 2/2012
WO 2012074686 6/2012

OTHER PUBLICATIONS

Patent Cooperation Treaty, Written Opinion of the International Searching Authority, dated Sep. 19, 2019, 7 pages.
(Continued)

*Primary Examiner* — David Carroll
(74) *Attorney, Agent, or Firm* — Robert A. Nissen

(57) ABSTRACT

The document relates to an anti-extrusion tool/assembly, and a sealing system. The an anti-extrusion assembly has an elongated backup member having a hollow body having a first end portion, a second end portion, an inner surface and an outer surface, and a plurality of elongated fingers provided at the second end portion of the hollow body, the plurality of elongated fingers extending axially parallel to the longitudinal axis of the backup member, and being movable between a first un-deployed configuration and a second deployed configuration; and a cam member having an elongated portion configured for insertion into the backup member or for receiving the backup member, and a cam portion having a cam surface and an engagement surface, the cam surface is configured to contact the ends of the plurality of elongated fingers; and adjacent elongated fingers are configured to be in contact with each other in the deployed configuration.

27 Claims, 10 Drawing Sheets

(56) References Cited

U.S. PATENT DOCUMENTS

| | | | | |
|---|---|---|---|---|
| 6,827,150 | B2 * | 12/2004 | Luke | E21B 33/1216 166/138 |
| 7,004,248 | B2 | 2/2006 | Hoffman | |
| 8,393,388 | B2 | 3/2013 | Bishop | |
| 8,651,178 | B2 | 2/2014 | Mercer | |
| 9,670,747 | B2 | 6/2017 | Ruffo | |
| 9,816,346 | B2 | 11/2017 | Heggestad | |
| 10,087,693 | B2 | 10/2018 | Bye | |
| 10,364,639 | B2 | 7/2019 | Svartvatn | |
| 10,612,339 | B2 * | 4/2020 | Murphy | E21B 34/14 |
| 10,718,178 | B2 | 7/2020 | Kellner | |
| 10,801,284 | B2 | 10/2020 | Brown | |
| 2004/0007366 | A1 * | 1/2004 | McKee | E21B 33/1216 166/387 |
| 2012/0037355 | A1 * | 2/2012 | Bishop | E21B 33/128 166/119 |
| 2015/0060088 | A1 | 3/2015 | Goodman | |
| 2015/0275619 | A1 | 10/2015 | Slup | |
| 2019/0360288 | A1 | 11/2019 | Brown | |

OTHER PUBLICATIONS

Patent Cooperation Treaty, International Search Report, dated Sep. 19, 2019, 4 pages.

* cited by examiner

ANTI-EXTRUSION ASSEMBLY AND A SEALING SYSTEM COMPRISING SAME

FIELD OF THE INVENTION

The present invention pertains to the field of downhole tools, in particular to an anti-extrusion assembly for a sealing system for downhole tools.

BACKGROUND OF THE INVENTION

In oil and gas wells zone isolation is accomplished by placing sealing systems, such as bridge plugs, packers, etc., inside the casing or open hole, to isolate producing zones or to direct the flow of production fluids to the surface. For example, a bridge plug is placed within the casing to isolate upper and lower sections of production zones. By creating a pressure seal in the wellbore, bridge plugs allow pressurized fluids or solids to treat an isolated formation.

Typically a wellbore is lined with tubular or casing to strengthen the sides of the borehole and isolate the wellbore from the surrounding earthen formation. In order to access production fluid in a formation adjacent the wellbore, the casing is perforated, allowing the production fluid to enter the wellbore and be retrieved at the surface of the well. In other situations, there may be a need to isolate the bottom of the well from the wellhead. It then becomes necessary to seal the tubing with respect to the well casing to prevent the fluid pressure of the slurry from lifting the tubing out of the well or for otherwise isolating specific zones in which a wellbore has been placed. In other situations, there may be a need to create a pressure seal in the wellbore allowing fluid pressure to be applied to the wellbore to treat the isolated formation with pressurized fluids or solids. Down hole tools, referred to as bridge, plugs, packers, and like, are designed to achieve zone isolation for the aforementioned general purposes.

A sealing system generally includes a sealing tool (usually constructed of cast iron, aluminum, or other drillable alloyed metals) and a compliant seal that is typically made of a composite or elastomeric material that seals off an annulus within the wellbore to prevent the passage of fluids. The sealing tool must pass through the inner diameter as it is deployed to the correct depth, where it is set to create a seal with the inner diameter, isolating the pressure in different zones of the well. Upon actuation, the sealing element is axially compressed, thereby causing the sealing element to expand radially outward from the tool to sealingly engage a surrounding surface of the tubular.

The compliant materials of the seal deform with relatively low forces applied allowing for the seal to fill the gland and contact multiple surfaces. These contact areas prevent flow across the seal and generate a pressure difference. The extrusion gap is the gap between the two materials which are being sealed. If too much pressure is applied the seal can deform and be forced into the extrusion gap causing failure. Larger gaps are more difficult to seal at high pressure.

A packer must be able to pass through the smallest possible diameter and then seal on the largest. The tolerance on the inner diameter of casing is generally large as it is a combination of the tolerance on the outer diameter and the weight/unit length. This gap creates a relatively large extrusion gap that the sealing element could be pushed through by pressure causing a failure. There are also cases where a packer will need to pass through an obstruction which increases the potential extrusion gap.

Several attempts have been made to achieve effective sealing and zone isolation via different types of sealing systems.

US Publication No. 2017/021 1348 discloses a sealing tool comprising an expandable seal element and an elastically support, which is deformable between an unexpanded configuration and a radially expanded configuration. The support includes a plurality of base portions, and a plurality of overlap portions, each overlap portion extend from a respective base portion so that it overlaps the surface of an adjacent base portion and has a surface which, in use, faces towards the seal element. The base portions and the overlap portions are arranged to define a generally ring-shaped seal support structure which forms a continuous circumferentially extending support surface for abutting and supporting the seal element.

U.S. Pat. No. 8,662,161 discloses an expandable packer with expansion induced axially movable support ring having alternating flat fingers that are deformed outwards with bridges. This packer uses mandrel expansion and movable ring with an internal taper to match an undercut on the mandrel exterior. Shrinkage of the mandrel axially due to radial expansion brings a ring on the mandrel outer surface under the fingers to act as a support for the fingers against the seal which is pushed against the open hole.

US Publication No. 2016/0123100 discloses an angled segmented backup ring including a plurality of slots extending radially inward from an outer surface and extending axially parallel to one another and non-parallel to a longitudinal axis and a plurality of the segments defined by the plurality of slots.

PCT Publication No, WO 2017/109508 discloses a complicated expanding and collapsing ring comprising a plurality of interlocking elements assembled together to form a ring structure oriented in a plane around a longitudinal axis. The plurality of elements is operable to be moved between the expanded and collapsed conditions/configurations by sliding with respect to one another in the plane of the ring structure.

The above discussed sealing systems comprise complicated mechanisms, cannot fully conform to the casing, provide uneven support and/or cannot seal the extrusion gaps properly.

There is therefore need for a sealing system which that is not subject to one or more limitations of the prior art.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide an anti-extrusion tool/assembly, and a sealing system comprising same.

In accordance with an aspect of the present invention, there is provided an anti-extrusion assembly comprising a) an elongated backup member having a hollow body having a first end portion, a second end portion, an inner surface and an outer surface, and a plurality of elongated fingers provided at the second end portion of the hollow body, the plurality of elongated fingers extending axially parallel to the longitudinal axis of the backup member, the plurality of elongated fingers being movable between a first un-deployed configuration and a second deployed configuration; and b) a cam member having an elongated portion configured for insertion into the backup member or for receiving the backup member, and a cam portion having a cam surface and an engagement surface, wherein the cam surface is configured to contact the ends of the plurality of elongated fingers; wherein adjacent elongated fingers are configured to be in contact with each other in the deployed configuration.

In accordance with another aspect of the present invention, there is provided a sealing system for use in a tubular body, which comprises: (a) a first anti-extrusion assembly comprising a first elongated backup member having a hollow body having a first end portion, a second end portion, an inner surface and an outer surface, and a plurality of elongated fingers provided at the second end portion of the hollow body, the plurality of elongated fingers extending axially parallel to the longitudinal axis of the backup member, the plurality of elongated fingers being movable between a first un-deployed configuration and a second deployed configuration; and a first cam member having an elongated portion configured for insertion into the backup member or for receiving the backup member, and a cam portion having a cam surface and an engagement surface, wherein the cam surface is configured to contact the ends of the plurality of elongated fingers; and (b) a deformable sealing element, adapted at a first end thereof for contacting the engagement surface of the cam portion of the cam member; wherein upon application of an axial compression force on the anti-extrusion assembly, the sealing element is deformed into sealing contact with a wall of the tubular body, and the cam surface of the cam portion causes the plurality of elongated fingers to move into the second deployed configuration, wherein the ends of the plurality of elongated fingers contact the cam surface and wall of the tubular body to plug a extrusion gap between the cam member and the tubular body, and wherein adjacent elongated fingers are in contact with each other in the deployed configuration.

In accordance with another aspect of the invention, there is provided a sealing system further comprising a second elongated backup member having a hollow body having a first end portion, a second end portion, an inner surface and an outer surface, and a plurality of elongated fingers formed at the first end portion of the hollow body, the plurality of elongated fingers extending axially parallel to the longitudinal axis of the backup member, the plurality of elongated fingers being movable between a first un-deployed configuration and a second deployed configuration; and a second cam member having an elongated portion configured for insertion into the second backup member or for receiving the second backup member, and a cam portion having a cam surface and an engagement surface, wherein the cam surface is configured to contact the ends of the plurality of elongated fingers of the second backup member; wherein the deformable sealing element is adapted at a second end thereof for contacting the engagement surface of the second cam member.

DETAILED DESCRIPTION OF THE INVENTION

Figure 1A:
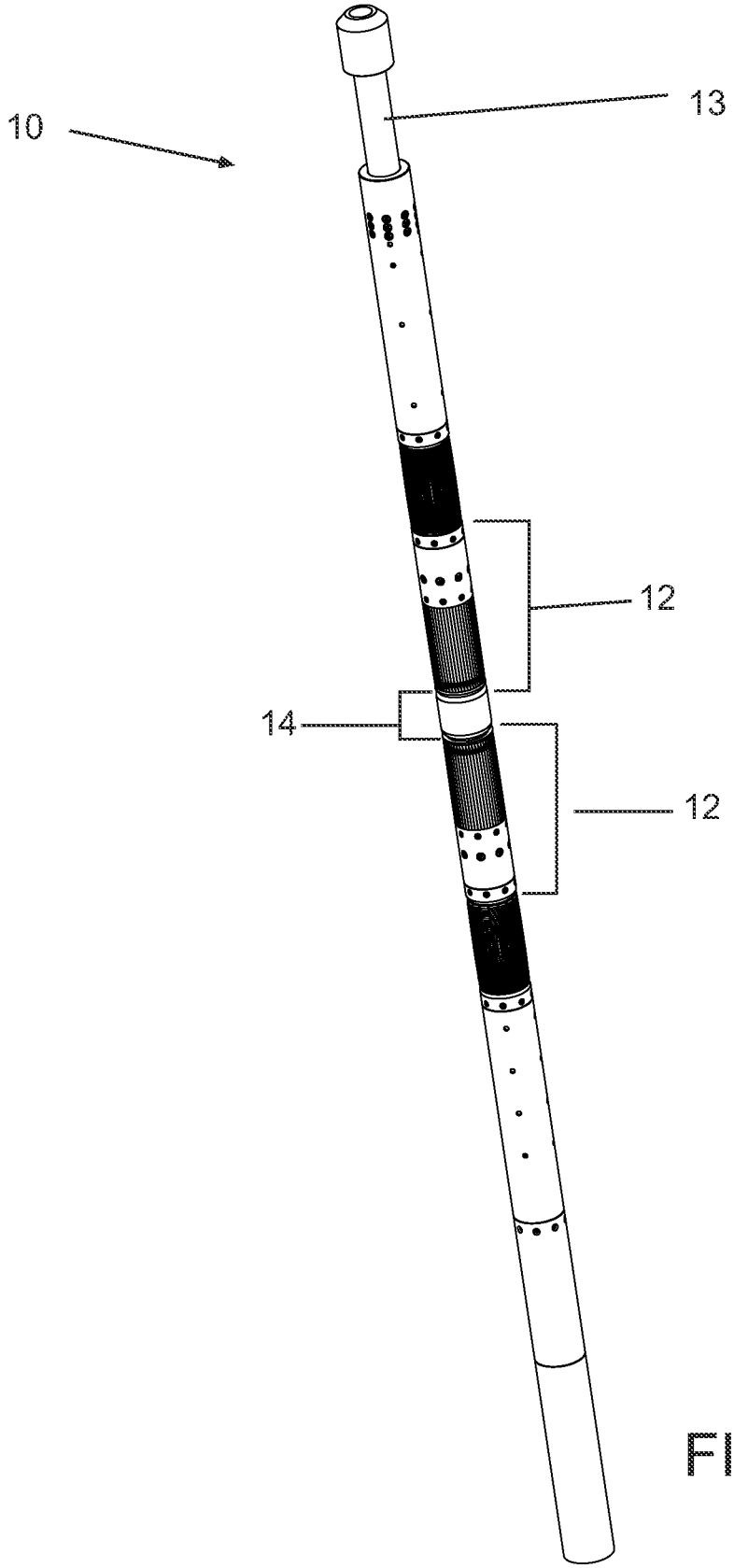
FIG. 1A illustrates a perspective view of a sealing system in accordance with an aspect of the present invention.

Unless defined otherwise, all technical and scientific terms used herein have the same meaning as commonly understood by one of ordinary skill in the art to which this invention belongs.

The present invention provides an anti-extrusion sealing assembly, and a sealing system comprising same, for use with a tubular body.

The anti-extrusion assembly and the sealing system of the present invention reduces the extrusion gap allowing for higher pressure to be sealed, and higher pressure differentials across a seal.

The anti-extrusion assembly and the sealing system of the present invention has a simple construction and mechanism of action, can expand or contract into the extrusion gap while supporting the sealing elements, allowing for effective high pressure sealing. The sealing system of the present invention has the ability to easily pass through obstructions and has the flexibility of sealing a large range of inner diameters.

The sealing system of the present invention comprises at least one anti-extrusion assembly and at least one deformable sealing element.

The anti-extrusion assembly comprises an elongated backup member and a cam member. The elongated backup member has a hollow body having a first end portion, a second end portion, an inner surface and an outer surface. A plurality of elongated fingers are provided at the second end portion of the hollow body. The elongated fingers extend axially parallel to the longitudinal axis of the backup member, and are movable between a first un-deployed configuration and a second deployed configuration.

The cam member has an elongated portion, which is configured for insertion into the backup member or to receive the insertion member, and angled cam portion having a cam surface and an engagement surface. The cam surface is configured to contact the ends of the plurality of elongated fingers.

The sealing element of the sealing system of the present invention is adapted to contact to the engagement surface of the cam portion of the cam member, such that upon application of an axial compression force on the anti-extrusion assembly, the sealing element is deformed into sealing contact with a wall of the tubular body, and the cam surface of the cam portion causes the plurality of elongated fingers to move into the second deployed configuration, wherein the ends of the plurality of fingers contact the cam surface and wall of the tubular body to plug an extrusion gap between the cam member and the tubular body, and adjacent elongated fingers are configured to remain in contact with each other in the deployed configuration.

The backup member of the present invention is configured to create a radially compliant structure while maintaining axial and torsional rigidity.

In some embodiments, the backup member is manufactured in one piece with slots/slits/cutaways to create the fingers.

In some embodiments, the backup member comprises different components attached together. In some embodiments, the elongated fingers are attached to one end of the hollow body.

In some embodiments, the elongated fingers are radially flexible and axially stiff.

In some embodiments, the elongated fingers are each separated by a slit/cutaway, wherein each the slit/cutaway is oriented in a direction that is tangential or near tangential to the inner surface of the hollow body. The slits/cutaways radiate in one direction from the tangential point in either a right-handed or left-handed manner so that no cutaways bisect any other.

The system of the present invention can be configured to seal an inner diameter or an outer diameter of a tubular body.

In the embodiments configured for sealing an inner diameter of a tubular body, the elongated portion of the cam member is configured for insertion into the backup member, and the sealing element is configured to deform radially outward to contact the inner wall of the tubular body to create a seal upon application of the axial compression force. In such embodiments, the cam surface is angled radially outward (i.e. a conical shape) and at least the ends of elongated fingers are configured to expand radially outward upon application of the axial force.

In the embodiments configured for sealing an outer diameter of a tubular body, the elongated portion of the cam member is configured for receiving the backup member, and the sealing element is configured to deform radially inward to contact an outer wall of the tubular body to create a seal upon application of the axial force. In such embodiments, the cam surface is angled radially inward (i.e. an inverse conical shape) and at least the ends of the elongated fingers are configured to contract radially inward to upon application of the axial compression force.

In some embodiments, the ends of the elongated fingers are angled to form an end surface that matches the angle of the cam surface.

In some embodiments, the free ends of the elongated fingers are machined to form an outer surface that maximises contact with the wall of the tubular body, and an end surface that maximises contact with the cam surface.

In some embodiments, the fingers of the backup member can be machined in the deployed configuration allowing for the extrusion gap to be completely reduced. For example, in the system for sealing an inner diameter of a tubular body, the fingers of the backup member are expanded into final position and then the outer diameter, and end face are machined. This results in a component that, when deployed, closely matches the shape of the cam and the sealing inner diameter.

When the axial deployment force is applied, due to the angle in the cam portion, the fingers expand (or contract) radially around the cam portion and contact the inner surface (or the outer surface) of the tubular body. Once deployed, the end surface of the backup member matches the angle of the cam surface, resulting in no gaps for the extrusion of the sealing element. It also provides a large contact area for the cam member to be held in place by the backup member when pressure is acting on the sealing element, thus preventing damage on the cam member and backup member interface. When the backup member is fully deployed, there are no gaps between each of the fingers. As the sections are flexed radially they will also rotate as required and match without any gaps. The fingers would slide relative to each other as they are deployed.

The deformable sealing element can be a single elastomeric seal, or a seal stack consisting of multiple components as are commonly known in the industry.

This anti-extrusion system can be configured to hold high pressure in a single direction or in two directions. The single direction system would have a single anti-extrusion assembly comprising a backup member and a cam member on one side of the sealing element. A system for holding pressure in both directions would comprise an anti-extrusion assembly comprising a backup member and a cam member on each side of the sealing element.

In the embodiments comprising more than one sealing assemblies, two adjacent assemblies can be arranged such that the engagement surface of the cam member of one assembly contacts the sealing element at an end opposite to the end of the sealing element in contact with the engagement surface of the cam member of the other assembly.

In some embodiments, the second end portion of the backup member is coupled with the elongated portion of the cam member to control axial movement of the backup member relative to the cam member. For example, the elongated portion can be provided with a plurality of slots, and the second end portion of the backup element is provided with a plurality of corresponding apertures, wherein each aperture is coupled to its corresponding slot via a coupling member, such as pins and bolts.

In some embodiments, the anti-extrusion assemblies are provided each with a shear-mechanism comprising one or more shear pins and one or more shear pistons, and slots provided in the backup member configured to receive the shear pins.

The shear mechanism is provided to deploy the device in a sequential order to maximize the chance of successful sealing through axial compression. The typical method to accomplish this is to maintain one end in a fixed position and apply the compression force to the other end. For example, in a system configured to seal an inner diameter of a tubular body, and provided with the shear mechanism, the fingers of the backup member would initially expand radially to a smaller diameter than the tubular body inner diameter. The fingers are prevented from fully expanding radially by the shear mechanism restricting the axial travel. Once the required force is reached, the shear pins would shear and allow the cam member and the backup member to move further towards the sealing element, thus allowing the fingers to be fully expanded radially over the cam portion of the cam member.

In a system comprising more than one anti-extrusion assemblies, the number of shear pins used in the shear mechanism will determine which backup member would be fully deployed first. This is selected to minimize the axial travel of the selected backup member within the tubular body while fully deployed (i.e. fully expanded or fully contracted). When the fingers of a backup member are fully deployed before completing the axial travel, it will be firmly pressed into the tubular body sealing face causing significant friction. This friction could cause the device to hang up and not be fully deployed or cause damage to the backup member. Use of the shear mechanism/assembly allows most of the axial travel to have been completed prior to the contact of the fingers with the tubular body sealing face.

The sealing system of the present invention can be used for both retrievable and non-retrievable applications. In non-retrievable applications, the anti-extrusion assembly is permanently deployed one time. In retrievable applications, the anti-extrusion assembly can be removed after deployment without damage.

In retrievable embodiments, the sealing element and the engagement surface of the cam member are operatively connected and configured to move the assembly and the sealing element upon application of axial tension. For example, the sealing element can be provided with one or more projections configured to interlock with a cavity on the engagement surface of the cam portion to render the assembly and sealing element retrievably movable under the application of an axial tension.

The backup member and the fingers can be made of any material that is more rigid than the sealing element and has a high enough flexibility to deploy without damage, such as steel.

In the sealing system of the present application, relative configurations and geometrical interfaces/interactions between the backup member, the corresponding cam member and the sealing element, result in reducing or eliminating extrusion gaps available for the sealing element to be extruded into, thereby preventing the seal from being extruded (even in larger extrusion gaps) and allowing for higher pressures across the seal.

The system of the present invention can be used in various different fields, such as in oil and gas wells (as bridge plugs or packers), mining, chemical processing, pipelines, power generation, water utilities, etc.

To gain a better understanding of the invention described herein, the following examples are set forth. It will be understood that these examples are intended to describe illustrative embodiments of the invention and are not intended to limit the scope of the invention in any way.

EXAMPLES

Figure 1B:
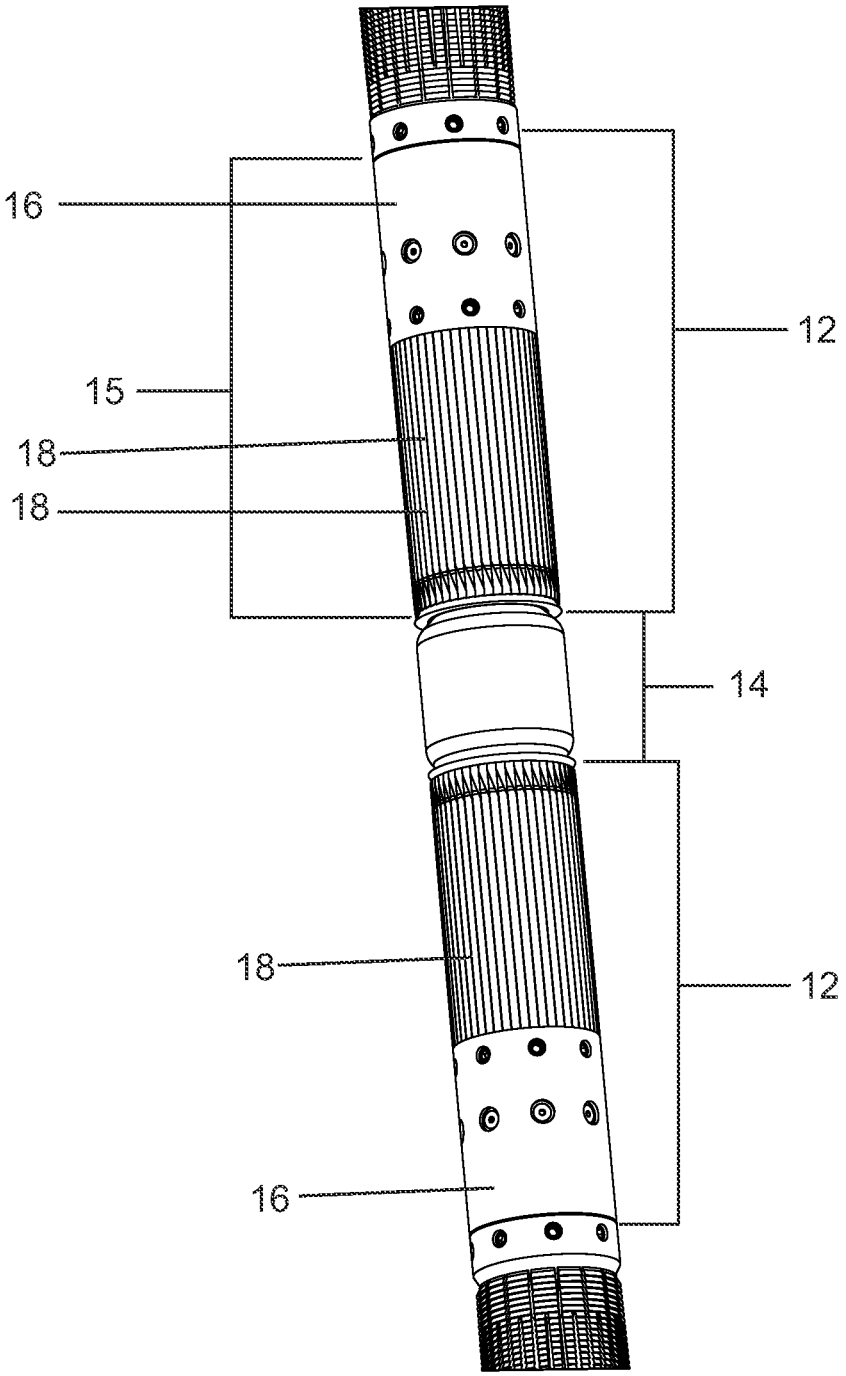
FIG. 1B is an enlarged view of the sealing system of FIG. 1A in an un-deployed/non-sealing configuration.
Figure 1C:
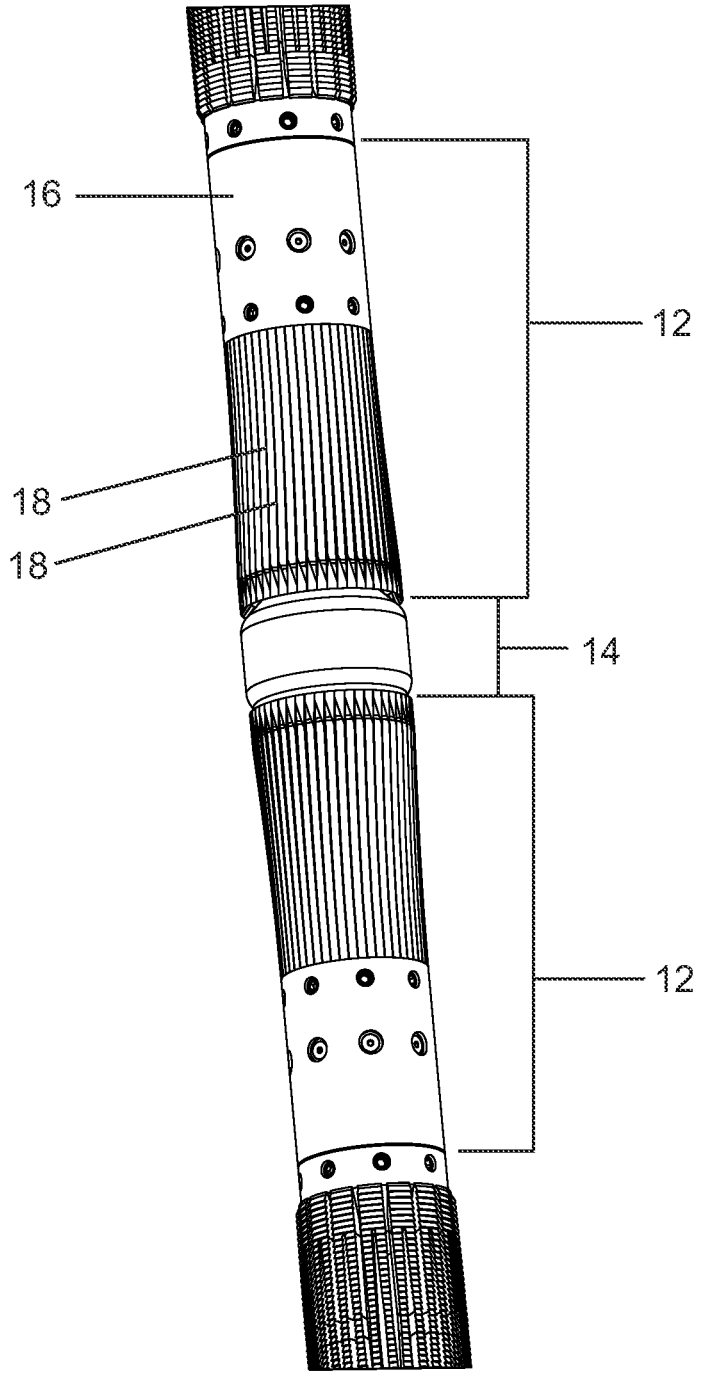
FIG. 1C is an enlarged view of the sealing system of FIG. 1A in a deployed/sealing configuration.

FIG. 1A depicts a perspective view of an exemplary sealing system 10 of the present invention showing two anti-extrusion assemblies 12, and a sealing element 14, assembled onto a mandrel 13 for deployment into a tubular body (i.e. in un-deployed configuration). FIG. 1B depicts an enlarged view of the sealing system of FIG. 1A.

Each anti-extrusion assembly 12 comprises a backup member 15 having a hollow body 16 with a plurality of elongated fingers 18 provided on one end portion thereof, and a cam member 30 configured for insertion in to the backup member.

Figure 2A:
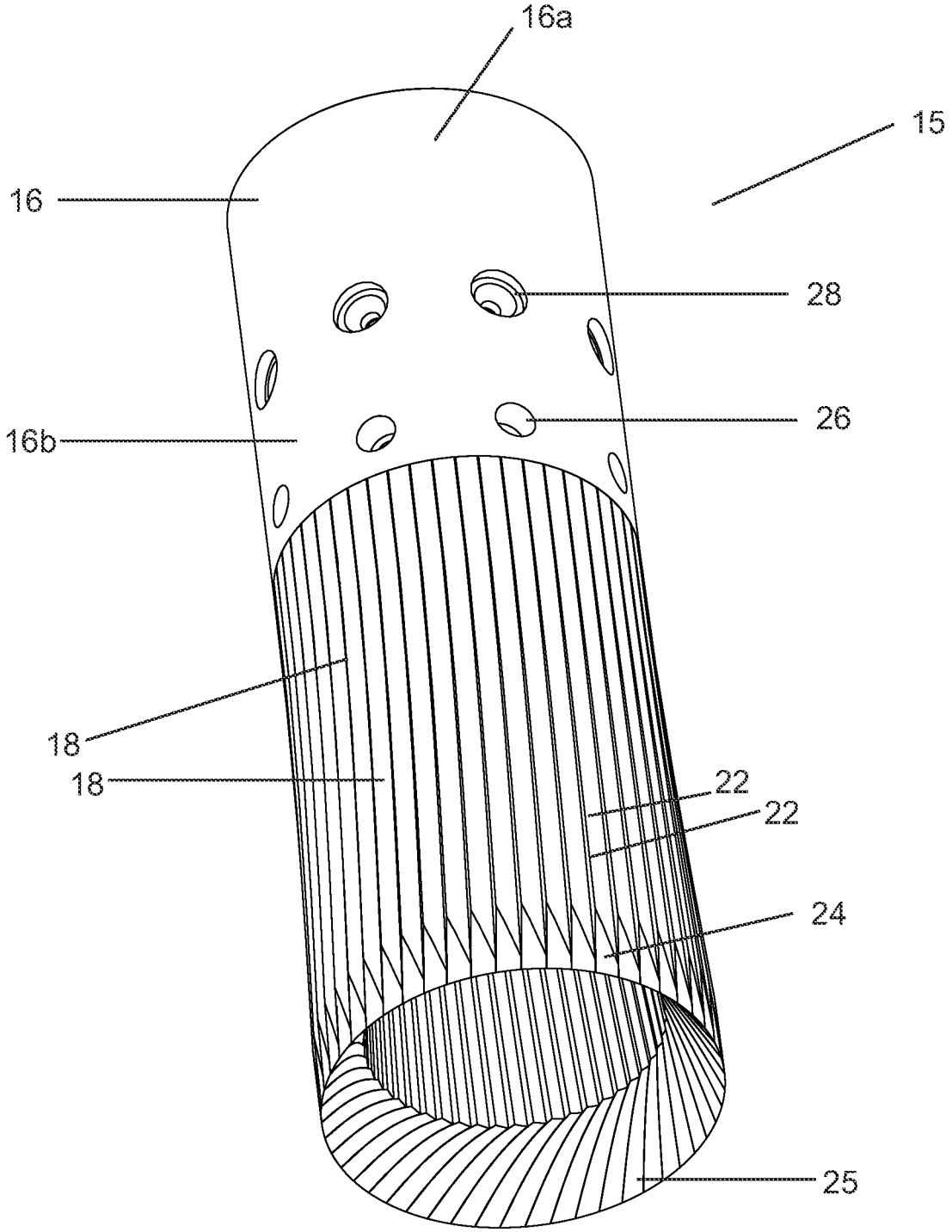
FIG. 2A is a perspective view of a backup member of the sealing system in accordance with an embodiment of the present invention, wherein the backup member is in the deployed/sealing configuration.
Figure 2B:
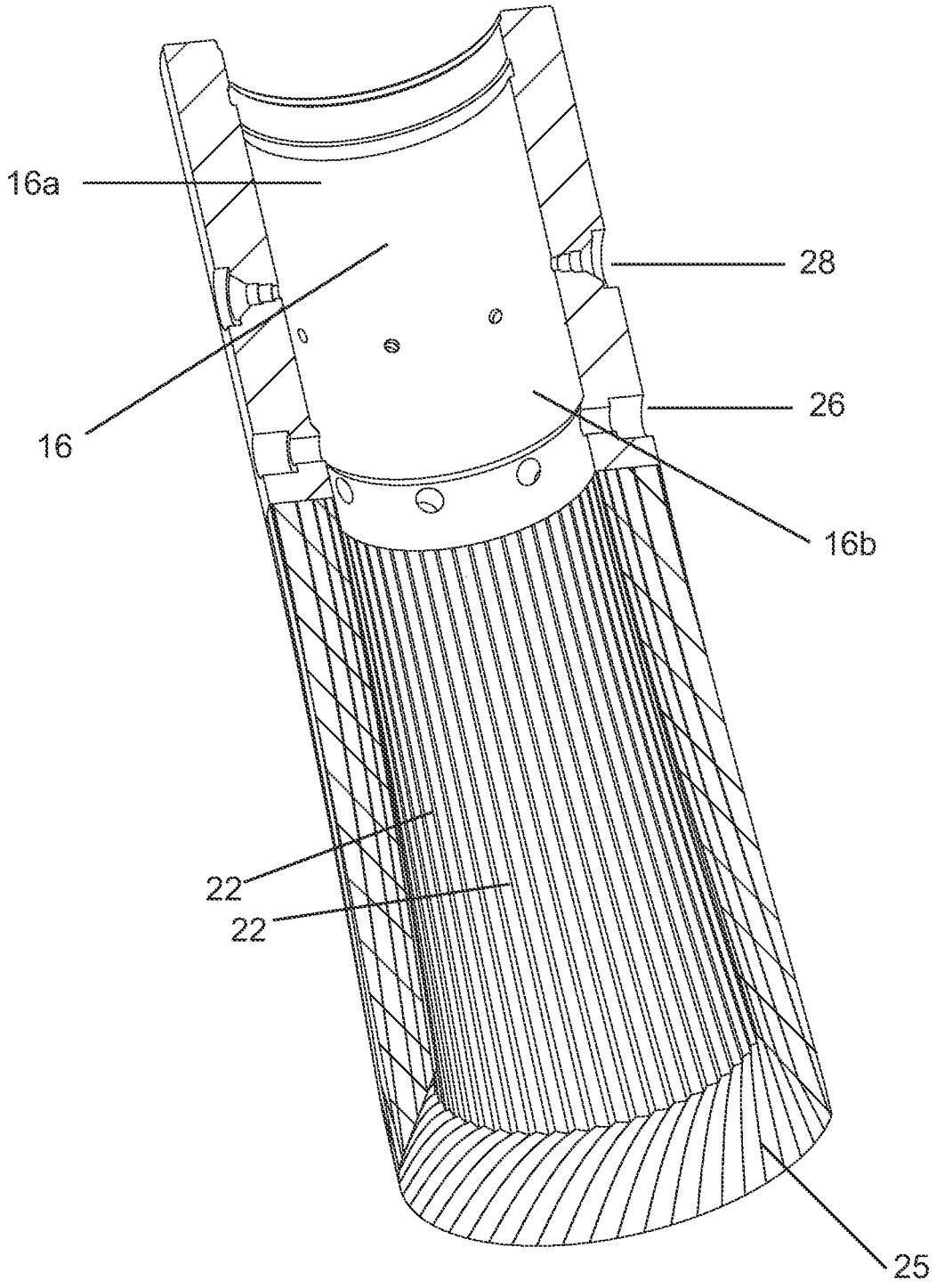
FIG. 2B is a cross sectional view of the backup member of FIG. 2A.
Figure 2C:
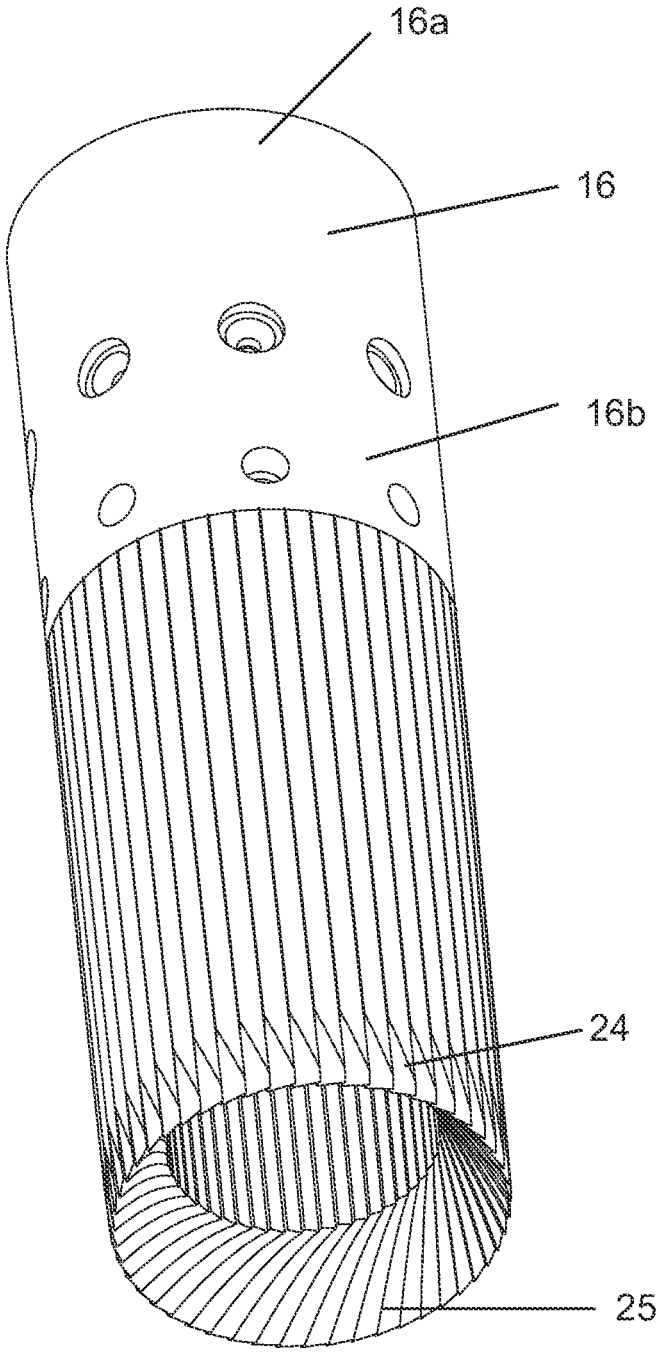
FIG. 2C is a perspective view of a backup member of the sealing system in accordance with an embodiment of the present invention, wherein the backup member is in the un-deployed/non-sealing configuration.
Figure 2D:
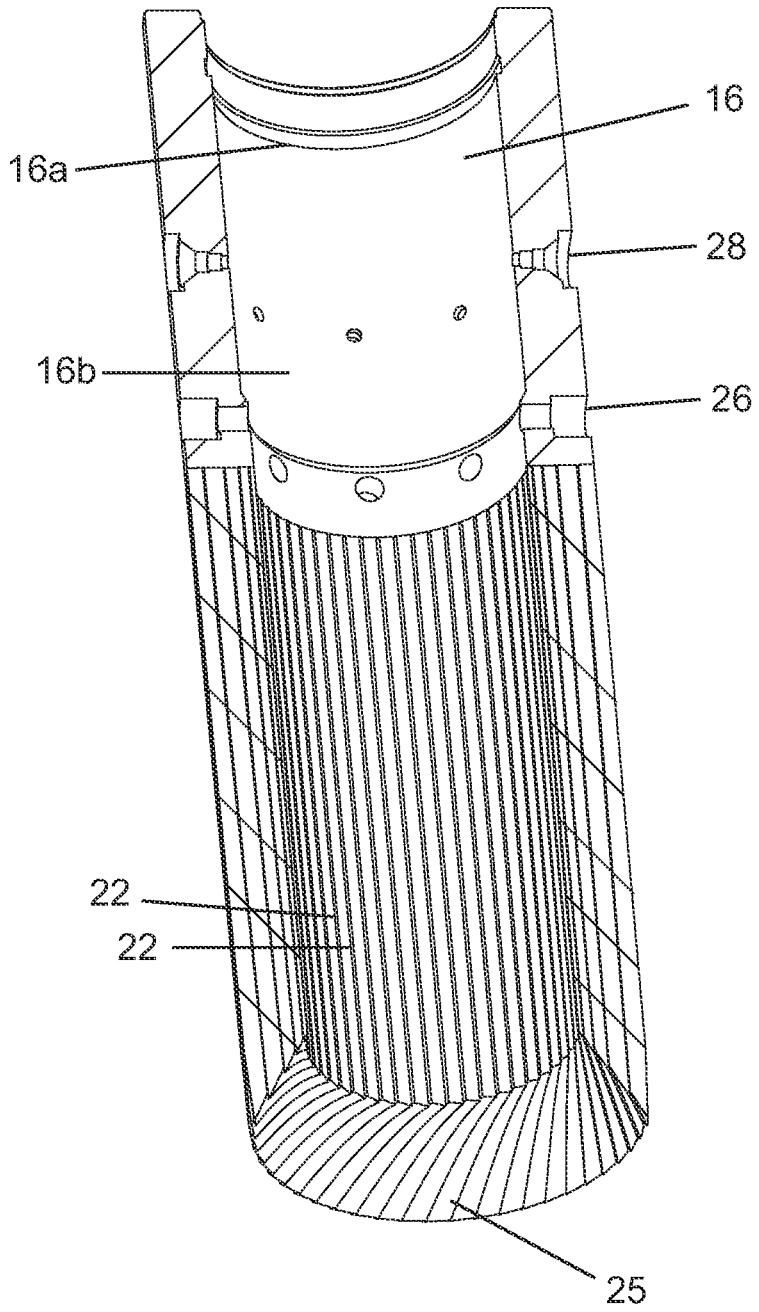
FIG. 2D is a cross sectional view of the backup member of FIG. 2C.

FIG. 2A depicts a perspective view of a backup member in deployed configuration, and FIG. 2C depicts a perspective view of the backup member in un-deployed configuration. FIGS. 2B and 2D depict cross sectional views of FIGS. 2A and 2C, respectively. As shown in FIGS. 2A-D, the backup member 15 has a hollow body 16 having a first end portion 16*a* and a second end portion 16*b*, and plurality of fingers 18 provided at the second end portion.

In this example, the backup member is manufactured in one piece with slots/slits/cutaways 22 to create the fingers. The cutaways 22 are designed to create a radially compliant structure while maintaining axial and torsional rigidity. The cutaways 22 are tangential or near tangential to the inner diameter, and radiate in one direction from the tangential point in either a right-handed or left-handed manner so that no cutaways bisect any other (FIGS. 2A-2D). The end of each finger is angled to form an outer surface 24 and a backup member end surface 25. The backup member is also provided with apertures 26 to receive pins or bolts, and shear pin openings 28.

Figure 3:
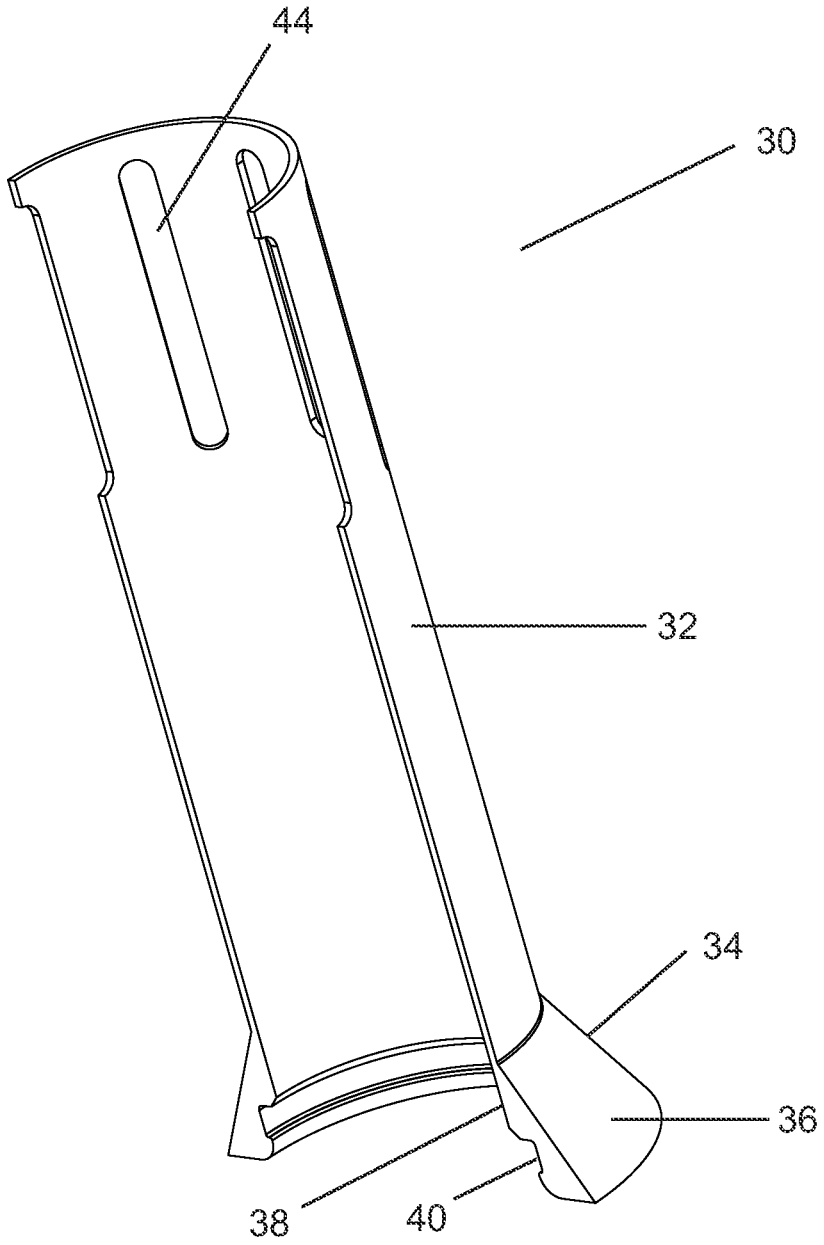
FIG. 3 is a cross sectional view of a cam member of the sealing system in accordance with an embodiment of the present invention.

FIG. 3 is a cross sectional view of the cam member 30 of an embodiment of the sealing system, which has an elongated insert portion 32 configured for insertion into the backup member 15, and an angled cam portion 34 having a cam surface 36 and an engagement surface 38. The insert portion is provided with axially extending slot 42 to receive corresponding pins through pin openings of the backup member. The engagement surface also has a cavity 40 configured to receive a corresponding projection or flange from the compliant seal 14.

As seen in FIGS. 2A-D, the end surface 25 of the backup member is angled to match the angle of the cam surface 36.

Figure 4A:
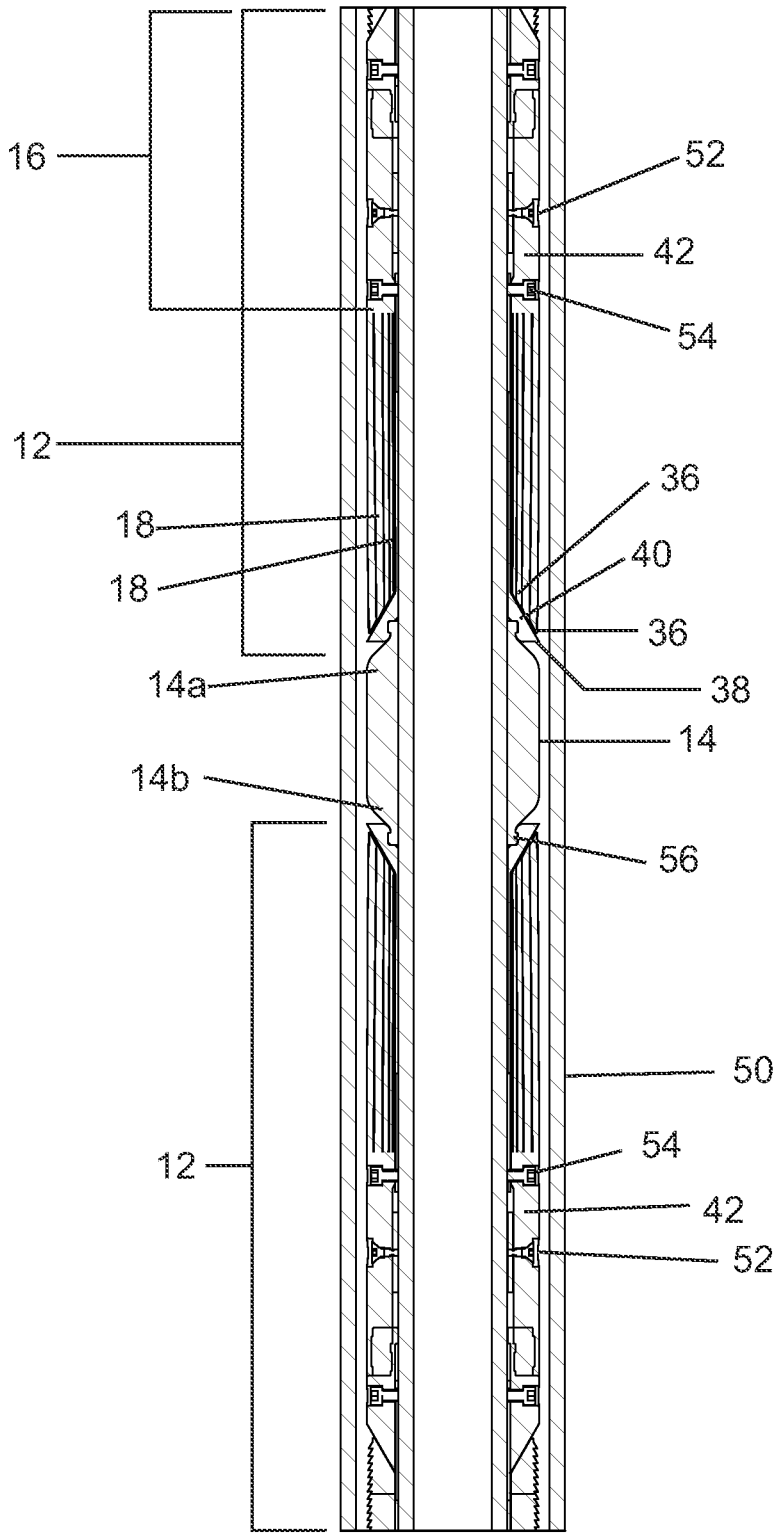
FIG. 4A is a cross sectional view of a section the sealing system in accordance with an embodiment of the present invention, wherein the system is in the un-deployed/non-sealing configuration.
Figure 4B:
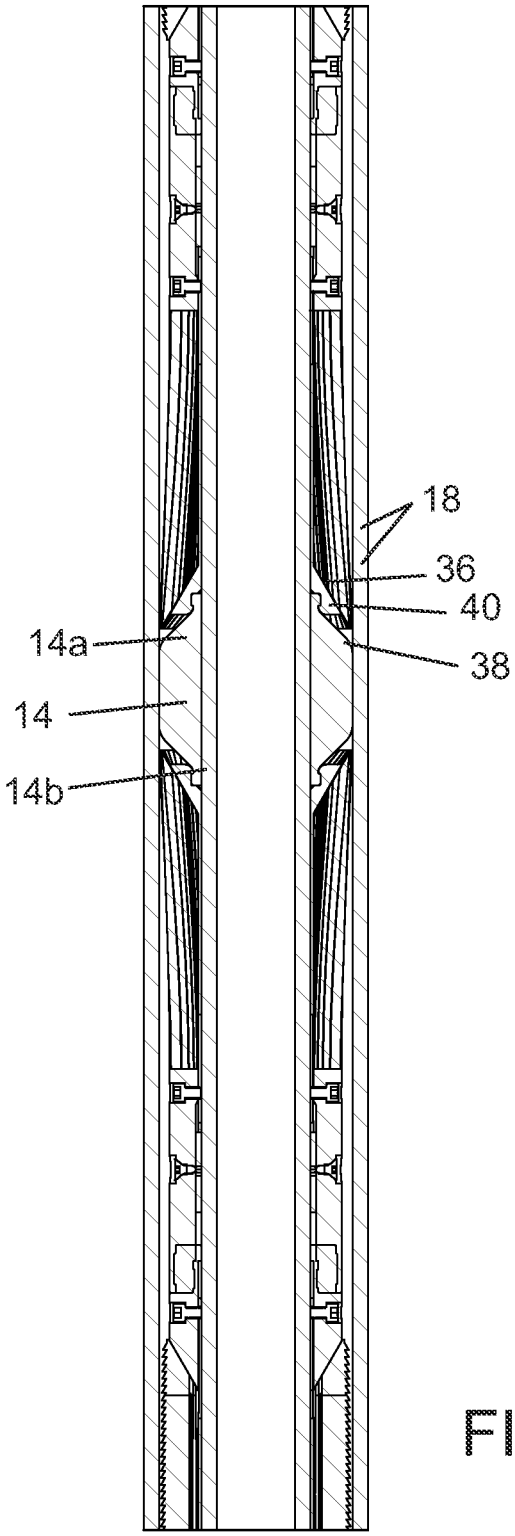
FIG. 4B is a cross sectional view of a section of the sealing system in accordance with an embodiment of the present invention, wherein the system is in the deployed/sealing configuration.

FIG. 4A depicts a cross sectional view of a section of the sealing system in an un-deployed/non-sealing configuration, and FIG. 4B depicts a cross sectional view of a section of the sealing system in a deployed/sealing configuration.

FIGS. 4*a* and 4B show two seal assemblies 12 placed in a tubular body 50. Each assembly comprises a backup member having elongated body 16 and the plurality of elongated fingers 18. The insert portion of the respective cam member is inserted into the backup portion (therefore not visible), while the cam portion 34 having the cam surface 36 and the engagement surface 38 is visible. A compliant seal 14 is provided between two adjacent assemblies, wherein the opposite end portions 14*a* and 14*b* of the compliant seal 14 are in contact with the cam portion of the corresponding assembly.

Prior to deployment, the compliant seal 14 is adjacent to the engagement surface 38 of the cam members, which support the compliant seal in the axial direction, and the end portions of the fingers are adjacent to the cam surface of the respective cam member. The cam surface 36 of each cam member is angled radially outward.

The assembly also contains an optional shear mechanism/assembly. The shear assembly consists of shear pins 52 received through the shear pin openings 28 of the backup member and in contact with the shear pin 42.

The assembly of FIGS. 4A and 4B can be designed for retrievable application, by providing one or more projections (lobes) 56 in the seal 14 which are configured to interlock with a corresponding annular cavity 40 of a cam member. The assembly is retrieved using axial tension. Once assembled onto a mandrel, the seal 14 and the cam member 30 can transmit axial tension.

The cam member 30 can be coupled to backup member 15 to transmit axial tension via axially extending slots 44 in the insert portion of the cam member 30. Pins or bolts 54 can be inserted through the apertures 26 backup of the backup member into the slots 42 of the cam member. The coupling of the cam member and the backup member restricts the axial travel of the cam member relative to the backup member.

The anti-extrusion assembly and the sealing system depicted in FIGS. 1 to 4 include fingers configured to expand radially outward to seal an inner diameter of the tubular body 50 when an axial force is applied.

While not shown in the figures, the anti-extrusion assembly and the sealing system of the present invention can be configured to seal on an outer diameter of a tubular body, wherein the fingers would contract radially inwardly when an axial force is applied. In this embodiment, the cam member 30 has an inverse conic shape which is angled radially inward. The fingers 18 of the element backup member 15 are inside of the cam member. When the axial force is applied the fingers of the element backup member are deformed inward radially so that they contact the outer seal diameter. The cam member and the deformed fingers of the backup member form a continuous support for the seal which limits or eliminates the extrusion gap.

Although the invention has been described with reference to certain specific embodiments, various modifications thereof will be apparent to those skilled in the art without departing from the spirit and scope of the invention. All such modifications as would be apparent to one skilled in the art are intended to be included within the scope of the following claims.

The embodiments of the invention in which an exclusive property or privilege is claimed are defined as follows:

1. A sealing system for use in a tubular body, comprising:

(a) an anti-extrusion assembly comprising:

an elongated backup member with a hollow body that has end portions, an inner surface and an outer surface, and a plurality of elongated fingers attached at one of the end portions of the hollow body, the plurality of elongated fingers extending axially relative to the longitudinal axis of the backup member, the plurality of elongated fingers being movable between an un-deployed configuration and a deployed configuration; and a cam member having an elongated portion configured for insertion into the backup member and an angled cam portion having a cam surface and an engagement surface, wherein the cam surface is configured to contact ends of the plurality of elongated fingers; and (b) a deformable sealing element, adapted for contacting the engagement surface of the cam portion of the cam member;

wherein upon application of an axial compression force on the anti-extrusion assembly, the sealing element is deformed radially outward into sealing contact with an inner wall of the tubular body, and the cam surface of the cam portion causes the plurality of elongated fingers to move into the deployed configuration by rotating the plurality of elongated fingers circumferentially, relative to the one of the end portions of the hollow body at which the plurality of elongated fingers attach, around the longitudinal axis to slide relative to one another and flex radially and torsionally, wherein when in the deployed configuration adjacent of the plurality of elongated fingers contact each other and the ends of the plurality of elongated fingers contact the cam surface and the inner wall of the tubular body to plug an extrusion gap between the cam member and the tubular body.

2. The sealing system according to claim 1, wherein adjacent of the plurality of elongated fingers are each separated by a slit when in the un-deployed configuration, wherein each slit is oriented in a direction that is tangential or near tangential to a circumference defined by an inner diameter of the hollow body, and each radiate in a right-handed or left-handed manner.

3. The sealing system according to claim 1 wherein the plurality of elongated fingers are radially flexible and axially stiff.

4. The sealing system according to claim 1, wherein the ends of the plurality of elongated fingers are angled to form an end surface that matches the angle of the cam surface.

5. The sealing system according to claim 1, wherein the ends of the plurality of elongated fingers are shaped to, when in the deployed configuration, form an outer surface that maximises contact with the inner wall of the tubular body, and an end surface that is shaped to, when in the deployed configuration, maximise contact with the cam surface and the deformable sealing element.

6. The sealing system of claim 1, wherein the cam surface is angled radially outward in a direction toward the ends of the plurality of elongated fingers, and the ends of the plurality of elongated fingers are configured to expand radially outward upon the application of the axial force.

7. The sealing system according to claim 1, wherein one of the end portions of the backup member is coupled with the elongated portion of the cam member to control axial movement of the backup member relative to the cam member.

8. The sealing system according to claim 7, wherein the elongated portion comprises a plurality of axially extending slots, and the backup member comprises a plurality of corresponding apertures, wherein each aperture is coupled to its corresponding slot via a coupling member.

9. The sealing system according to claim 1, further comprising a shear mechanism, comprising one or more shear pins received through shear pins openings provided in the elongated portion of the backup member and one or more shear pistons in contact with the shear pins.

10. The sealing system according to claim 1, wherein the sealing element is operatively connected to the engagement surface of the cam member to move the anti-extrusion assembly upon an application of an axial tension force on the anti-extrusion assembly.

11. The sealing system according to claim 10, wherein the sealing element has a projection configured to interlock with a cavity on the engagement surface of the cam portion to render the assembly retrievably movable upon the application of the axial tension force.

12. The sealing system according to claim 1, further comprising:

(c) a second anti-extrusion assembly comprising:

a second elongated backup member having a hollow body that has end portions, an inner surface and an outer surface, and a plurality of elongated fingers attached at one of the end portions of the hollow body, the plurality of elongated fingers extending axially relative to the longitudinal axis of the backup member, the plurality of elongated fingers being movable between an un-deployed configuration and a deployed configuration; and a second cam member having an elongated portion configured for insertion into the second backup member and an angled cam portion having a cam surface and an engagement surface, wherein the cam surface is configured to contact ends of the plurality of elongated fingers of the second backup member;

wherein the deformable sealing element is adapted for contacting the engagement surface of the second cam member.

13. The sealing system of claim 1 wherein one of the angled cam portion and the ends of the plurality of elongated fingers is conical and the other is inversely conical.

14. The sealing system according to claim 5 wherein, when in the deployed configuration, the end surface, formed by the ends of the plurality of the elongated fingers, forms a continuous circumferential support surface for abutting and supporting the deformable sealing element.

15. The sealing system according to claim 5 wherein, when in the deployed configuration, the outer or inner surface, formed by the ends of the plurality of elongated fingers, forms a continuous ring for contacting the wall of the tubular body.

16. A sealing system comprising the sealing system of claim 1 disposed within the tubular body, or disposed around the tubular body.

17. An anti-extrusion assembly for use with a tubular body, comprising:

an elongated backup member with a hollow body that has end portions, an inner surface and an outer surface, and a plurality of elongated fingers attached at one of the end portions of the hollow body, the plurality of elongated fingers extending axially relative to the longitudinal axis of the backup member, the plurality of elongated fingers being movable between an un-deployed configuration and a deployed configuration; and a cam member having an elongated portion configured for insertion into the backup member and an angled cam portion having a cam surface, wherein the cam surface is configured to contact ends of the plurality of elongated fingers;

wherein upon application of an axial force on the anti-extrusion assembly, the cam surface of the cam portion causes the plurality of elongated fingers to move into the deployed configuration by rotating the plurality of elongated fingers circumferentially, relative to the one of the end portions of the hollow body at which the plurality of elongated fingers attach, around the longitudinal axis to slide relative to one another and flex radially and torsionally, wherein when in the deployed configuration adjacent of the plurality of elongated fingers contact each other and the ends of the plurality of elongated fingers contact the cam surface and inner wall of the tubular body to plug an extrusion gap between the cam member and the tubular body.

18. The anti-extrusion assembly according to claim 17, wherein adjacent of the plurality of elongated fingers are each separated by a slit when in the un-deployed configuration, wherein each slit is oriented in a direction that is tangential or near tangential to a circumference defined by an inner diameter of the hollow body, and each radiate in a right-handed or left-handed manner.

19. The anti-extrusion assembly according to claim 17 wherein the plurality of elongated fingers are radially flexible and axially stiff.

20. The anti-extrusion assembly according to claim 17, wherein the ends of the plurality of elongated fingers are angled to form an end surface that matches the angle of the cam surface.

21. The anti-extrusion assembly according to claim 17, wherein the ends of the plurality of elongated fingers are shaped to, when in the deployed configuration, form an outer surface that maximises contact with the inner wall of the tubular body, and an end surface that is shaped to, when in the deployed configuration, maximise contact with the cam surface.

22. The anti-extrusion assembly of claim 17, wherein the cam surface is angled radially outward in a direction toward the ends of the plurality of elongated fingers, and the ends of elongated fingers are configured to expand radially outward upon an application of axial force on the anti-extrusion assembly.

23. The anti-extrusion assembly according to claim 17, wherein the backup member is coupled with an insert portion of the cam member to control axial movement of the backup member relative to the cam member.

24. The anti-extrusion assembly according to claim 23, wherein the insert portion further comprises a plurality of axially extending slots, and the backup member comprises a plurality of corresponding apertures, wherein each aperture is coupled to its corresponding slot via a coupling member.

25. The anti-extrusion assembly according to claim 23, further comprising a shear mechanism, comprising one or more shear pins received through shear pins openings provided in the elongated portion of the backup member and one or more shear pistons in contact with the shear pins.

26. The anti-extrusion assembly according to claim 17 wherein one of the angled cam portion and the ends of the plurality of elongated fingers is conical and the other is inversely conical.

27. The anti-extrusion assembly according to claim 21 wherein, when in the deployed configuration, the end surface, formed by the ends of the plurality of the elongated fingers, forms a continuous circumferential support surface for abutting and supporting a deformable sealing element.

* * * * *